US010455952B2

(12) United States Patent
Smith

(10) Patent No.: US 10,455,952 B2
(45) Date of Patent: Oct. 29, 2019

(54) SKEWER FOR LOADING CUTLERY

(71) Applicant: JADE GROUP INTERNATIONAL LLC, West Bend, WI (US)

(72) Inventor: Patrick J. Smith, West Bend, WI (US)

( * ) Notice: Subject to any disclaimer, the term of this patent is extended or adjusted under 35 U.S.C. 154(b) by 0 days.

(21) Appl. No.: 16/318,394

(22) PCT Filed: Jul. 20, 2017

(86) PCT No.: PCT/US2017/042977
§ 371 (c)(1),
(2) Date: Jan. 17, 2019

(87) PCT Pub. No.: WO2018/017782
PCT Pub. Date: Jan. 25, 2018

(65) Prior Publication Data

US 2019/0281996 A1 Sep. 19, 2019

Related U.S. Application Data

(60) Provisional application No. 62/364,376, filed on Jul. 20, 2016.

(51) Int. Cl.
*A47F 1/10* (2006.01)
*A47G 21/02* (2006.01)

(52) U.S. Cl.
CPC ..... *A47F 1/10* (2013.01); *A47F 2001/103* (2013.01); *A47G 21/02* (2013.01)

(58) Field of Classification Search
CPC ..... A47F 1/00; A47F 1/04; A47F 1/08; A47F 1/10; A47F 2001/103; A47F 13/08; A47F 7/0007; A47F 7/0014; A47F 7/281; A47F 7/0035; A47F 7/0064; A47G 21/00; A47G 21/02; A47G 21/04; A47G 21/06; A47G 21/14; A47G 29/087; B65D 83/00; B65D 83/08; B65D 85/20; B65D 7/10; A47B 77/14; A47J 45/02; A47J 45/00; B42F 13/12; B42F 13/14
See application file for complete search history.

(56) References Cited

U.S. PATENT DOCUMENTS 4,134,519 A * 1/1979 Barnett ..... A47F 1/08 221/155
4,995,154 A * 2/1991 Bamber ..... A47G 21/06 30/147
5,899,356 A * 5/1999 Huisman ..... A47G 21/10 221/61
9,560,920 B2 * 2/2017 Oakes ..... A47F 1/125
(Continued)

FOREIGN PATENT DOCUMENTS

EP 1217923 B1 9/2003
WO 2017139527 A1 8/2017

*Primary Examiner* — Gene O Crawford
*Assistant Examiner* — Ayodeji T Ojofeitimi
(74) *Attorney, Agent, or Firm* — Shane Cortesi

(57) ABSTRACT

A lockable skewer for loading stacks of plastic cutlery into dispensers is described. The skewer comprises a vertical shaft that passes through holes in the cutlery. The vertical shaft includes a flange located below the bottom of the stack. The vertical shaft is configured to rotate between an unlocked position in which the flange is configured to pass through the holes in the cutlery pieces and a locked position in which the flange is not configured to pass through the holes in the cutlery pieces.

12 Claims, 7 Drawing Sheets

(56) References Cited

U.S. PATENT DOCUMENTS

| | | | | |
|---|---|---|---|---|
| 9,693,640 | B2 * | 7/2017 | Oakes | A47F 1/126 |
| 9,924,816 | B2 * | 3/2018 | Oakes | A47G 21/06 |
| 9,943,176 | B2 * | 4/2018 | Oakes | B65D 75/42 |
| 10,220,997 | B2 * | 3/2019 | Oakes | B65D 75/42 |
| 10,327,567 | B2 * | 6/2019 | Oakes | A47F 1/10 |
| 10,390,631 | B2 * | 8/2019 | Smith | A47F 1/10 |
| 2004/0052572 | A1 * | 3/2004 | Peters | B42F 13/14 402/60 |
| 2008/0022534 | A1 * | 1/2008 | Kim | A47G 21/02 30/142 |
| 2011/0296693 | A1 * | 12/2011 | Oakes | A47G 21/06 30/142 |
| 2012/0047744 | A1 * | 3/2012 | Walters | A47G 21/06 30/142 |
| 2012/0145734 | A1 * | 6/2012 | Walters | A47F 1/10 221/1 |
| 2012/0145735 | A1 * | 6/2012 | Erickson | A47F 1/10 221/1 |
| 2013/0043272 | A1 * | 2/2013 | Oakes | A47F 1/125 221/279 |
| 2015/0028045 | A1 * | 1/2015 | Oakes | B65D 75/42 221/1 |
| 2015/0028046 | A1 * | 1/2015 | Oakes | B65D 75/42 221/1 |
| 2015/0048108 | A1 * | 2/2015 | Borke | B65D 73/02 221/195 |
| 2015/0289679 | A1 * | 10/2015 | Oakes | A47F 1/125 221/1 |

* cited by examiner

SKEWER FOR LOADING CUTLERY

BACKGROUND

Technical Field

The present disclosure relates to plastic cutlery dispensers accessories, more particularly, to skewers for loading stacks of cutlery pieces into plastic cutlery dispensers.

Background of the Invention

Dispensers of plastic cutlery pieces (e.g., knives, spoons, forks and sporks) are well known in the art. U.S. Pat. No. 6,336,568 to Tucker, the entire contents of which are incorporated herein by reference, relates to a cartridge-type dispenser that dispenses cutlery pieces one at a time upon hand operation of an externally accessible utensil delivery controller.

The dispenser includes a housing having at least one interior compartment in communication with an exit opening. At least partially accommodateable within the interior compartment is a stack of cutlery within a cartridge capable of universally accommodating knives or forks or spoons and provided with a portal through which a single piece of cutlery can pass and wherein a dispensable piece of cutlery is situated. The portal is situated in a pathway aligned with the exit opening. Finally, the utensil delivery controller is an externally accessible hand operable ejector engageable with the cutlery and situated for ejecting the cutlery from the portal of the cartridge and thereafter through the pathway to the exit opening for ultimate user retrieval.

Other types of dispensers include dispensers in which the cutlery is loaded in the housing such as U.S. Pat. No. 8,210,364 to Smith, the entire contents of which are incorporated herein by reference. In U.S. Pat. No. 8,210,364 the dispenser generally includes a housing comprising: (a) an actuator, the actuator generally facing in a direction associated with a side of the housing; (b) an opening for loading disposable cutlery; (c) a dispensing chute through which the cutlery passes prior to ejection from the housing; and (d) at least one rocking cam comprising a displacement surface and having a first position and a second position, wherein upon activation of the actuator, the rocking cam moves from the first position to the second position and the displacement surface contacts at least one piece of cutlery, moving the at least one piece of cutlery in a generally lateral direction and toward the dispensing chute, wherein the generally lateral direction is towards the side of the housing in which the actuator is generally facing.

Certain dispensers require reloading the dispensers once all the cutlery is used. Such reloading takes time and, if incorrectly loaded, the dispenser could be prone to jamming. Also, if the person loading the dispenser has not washed her hands prior to loading, the utensils may be unhygienic.

U.S. Pat. No. 8,152,004 to Smith describes a banded packets of disposable cutlery that uses an adhesive.

European Patent No. 1,213,985 to Cassebasse teaches a rod that has one end a grip part and a retaining abutment that holds the top spoon in a stack of spoons in place and at the other end a retaining abutment which holds the bottom spoon in place and the rod is extracted by elastically retracting the elastic retaining projection as the first step in the extraction operation. The rod is inserted through a hole in the stack of spoons.

There is a continuing need for new methods of loading cutlery into dispensers.

BRIEF SUMMARY

A skewer system for loading a stack of cutlery into a cutlery dispenser is described herein. In some embodiments, the skewer system includes: a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side, a rear side, a width extending from the front side to the rear side and generally parallel to the stack width, an eating portion, a handle extending from the eating portion, the handle comprising a handle end and a non-circular hole extending from the cutlery piece top to the cutlery piece bottom; and b) a skewer removably attached to the stack and comprising a vertical shaft comprising a vertical shaft top located above the stack top, a vertical shaft bottom located below the stack bottom, a vertical shaft height extending from the vertical shaft top to the vertical shaft bottom and generally parallel to the stack height, and a vertical shaft flange located adjacent to the vertical shaft bottom and located below the stack bottom, the vertical shaft positioned through the non-circular holes of the cutlery pieces, the vertical shaft rotatable relative to the stack of cutlery pieces along a rotation axis generally parallel to the stack height, wherein the vertical shaft is configured to rotate about the rotation axis between a locked position in which the vertical shaft flange is unable to pass through the non-circular hole in the cutlery pieces and an unlocked position in which the vertical shaft flange is able to pass through the non-circular hole in the cutlery pieces.

Optionally, the system further comprises a lock configured to prevent the vertical shaft from freely rotating between the locked position and the unlocked position. Optionally, the skewer further comprises a front tab bar comprising a front tab bar top located above the top of the stack, a front tab bar bottom located below the bottom of the stack, and a front tab bar height extending from the front tab bar top to the front tab bar bottom, the front tab bar height generally parallel to the vertical shaft height and the stack height, the front tab bar extending along the stack height and confronting the front sides of the cutlery pieces as the front tab bar extends along the stack height and a top lateral extension extending from the front tab bar generally perpendicular to the front tab bar height and located directly above the top of the stack.

Optionally, the lock comprises a top lateral extension tooth located on the top lateral extension and a first vertical shaft slot located on the vertical shaft and above the stack top and configured to receive the top lateral extension tooth, and further wherein the top lateral extension tooth is located in the first vertical shaft slot when the vertical shaft is in the locked position. Optionally, the top lateral extension tooth is configured to flex and move out of the first vertical shaft slot when a user rotates the vertical shaft about the rotational axis. Optionally, the vertical shaft further comprises a second vertical shaft slot located on the vertical shaft between about 20 degrees and about 330 degrees relative to the first vertical shaft slot and above the stack top, and further wherein the top lateral extension tooth is located in the second vertical shaft slot when the vertical shaft is in the unlocked position. Optionally, the top lateral extension tooth is configured to flex and move out of the second vertical shaft slot when a user rotates the vertical shaft about the rotational axis. Optionally, the top lateral extension comprises a bottom surface facing the cutlery stack and a top surface opposite the bottom surface and further wherein the top lateral extension tooth is located on the bottom surface. Optionally, the skewer further comprises a handle located above the top lateral extension and configured to allow the user to rotate the vertical shaft about the rotational axis. Optionally, at least the portion of the vertical shaft extending along the stack height is generally cylindrical in shape. Optionally, the noncircular hole and the vertical shaft flange are substantially the same shape and size.

The present disclosure also provides a method of loading a cutlery dispenser comprising the steps of: a) providing a cutlery dispenser; b) loading the skewer system into the cutlery dispenser wherein the vertical shaft is in the locked position (and the top lateral extension tooth is in the first vertical shaft slot); c) rotating the vertical shaft between about 20 and about 330 degrees about the rotational axis (so that the top lateral extension tooth enters the second vertical shaft slot); d) lifting the vertical shaft through the noncircular holes; and e) removing the skewer without removing the cutlery stack from the cutlery dispenser.

BRIEF DESCRIPTION OF THE DRAWINGS

in FIG. 2, the vertical shaft flange is in the locked position.

in FIG. 3, the vertical shaft flange is in the locked position.

in FIG. 4, the vertical shaft flange is in the locked position.

in FIG. 5, the vertical shaft flange is in the locked position.

in FIG. 6, the vertical shaft flange is in the unlocked position.

in FIG. 7, the vertical shaft flange is in the unlocked position.

in FIG. 8, the vertical shaft flange is in the locked position.

in FIG. 9, the vertical shaft flange is in the locked position.

in FIG. 10, the vertical shaft flange is in the unlocked position.

DETAILED DESCRIPTION

Figure 1:
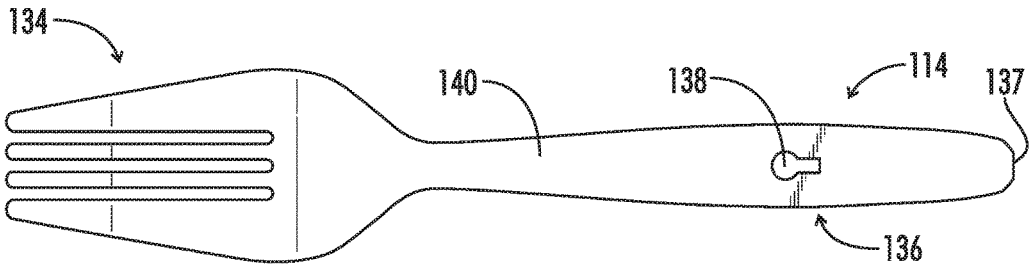
FIG. 1 illustrates a top plan view of a piece of cutlery with a hole for use with the skewer system of the present invention.
Figure 2:
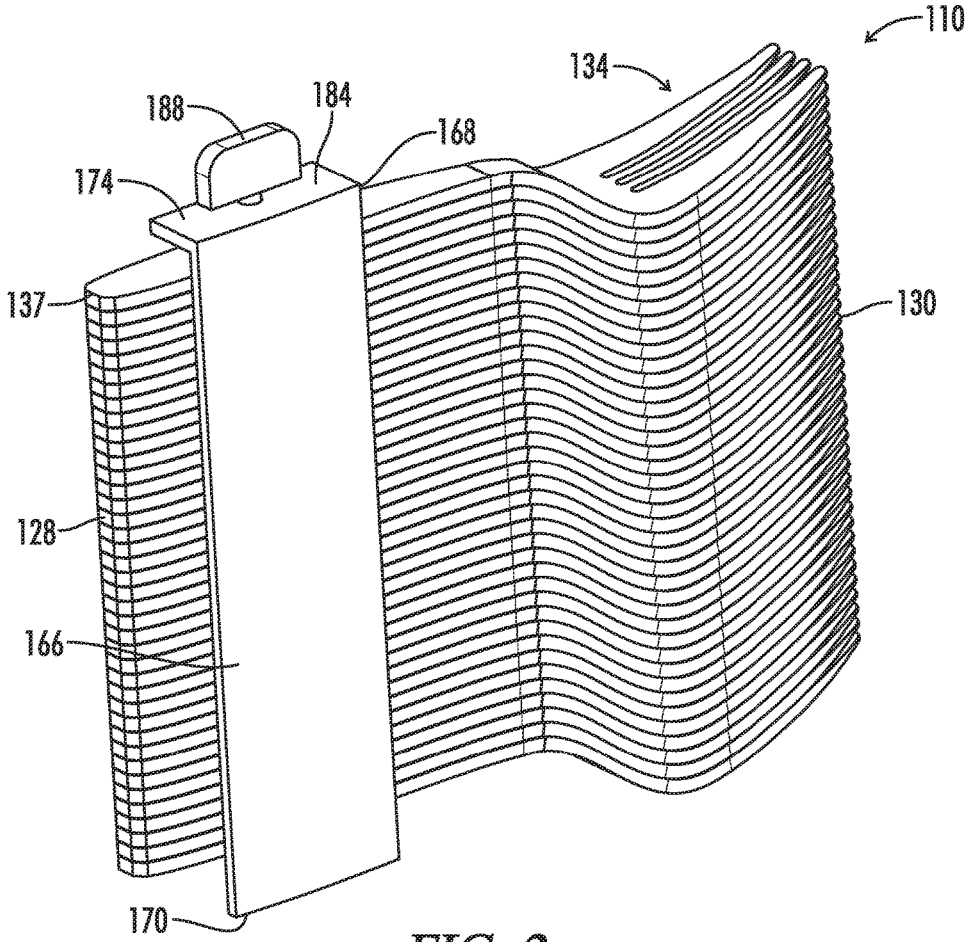
FIG. 2 illustrates a front perspective view of one embodiment of the skewer system of the present invention.
Figure 3:
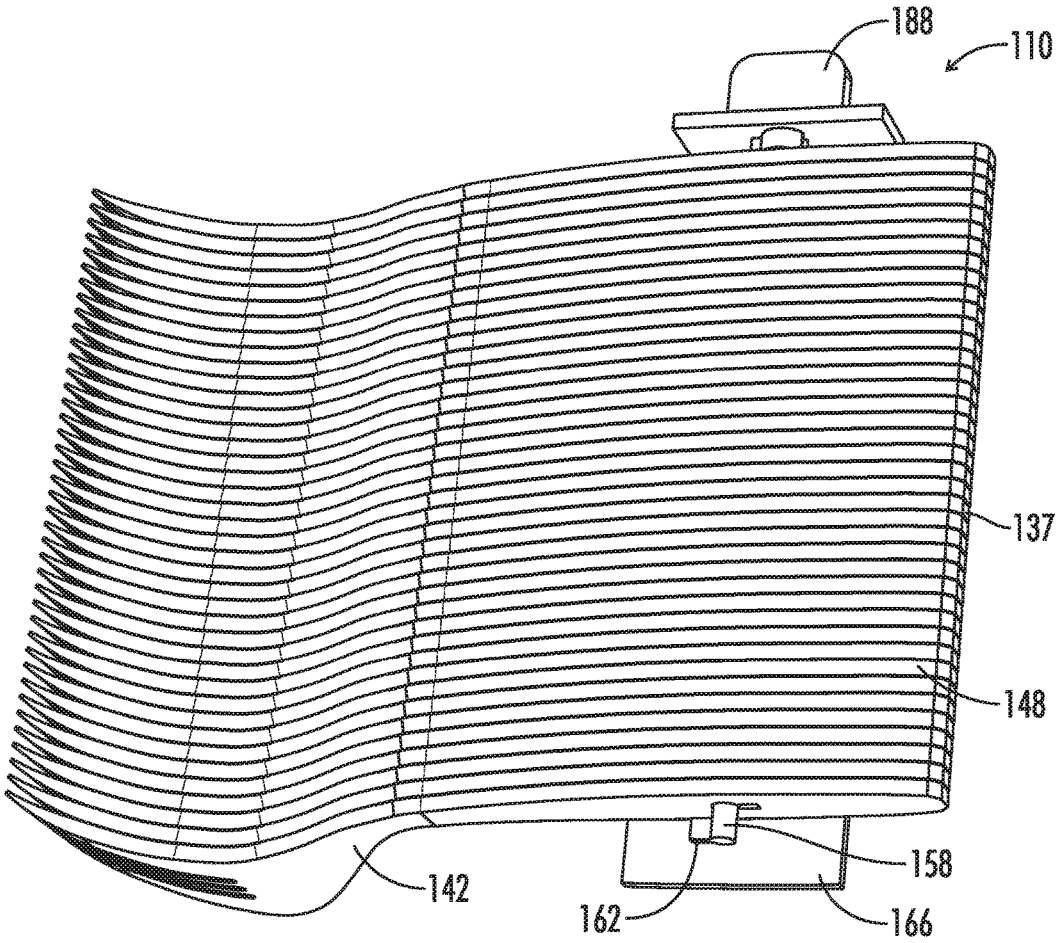
FIG. 3 illustrates a rear perspective view of the skewer system of FIG. 2.
Figure 4:
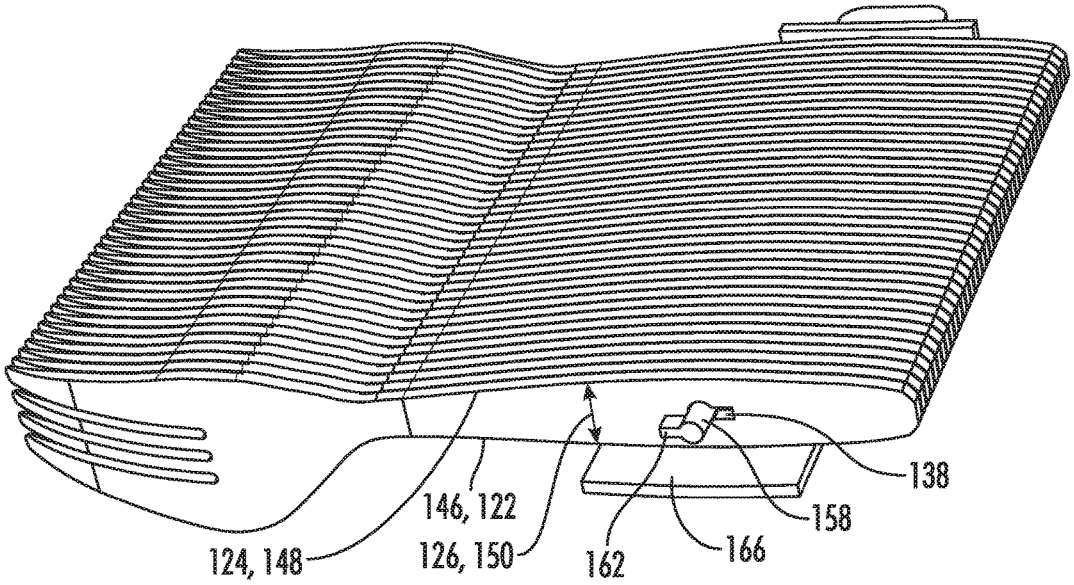
FIG. 4 illustrates a bottom perspective view of the skewer system of FIG. 2.
Figure 5:
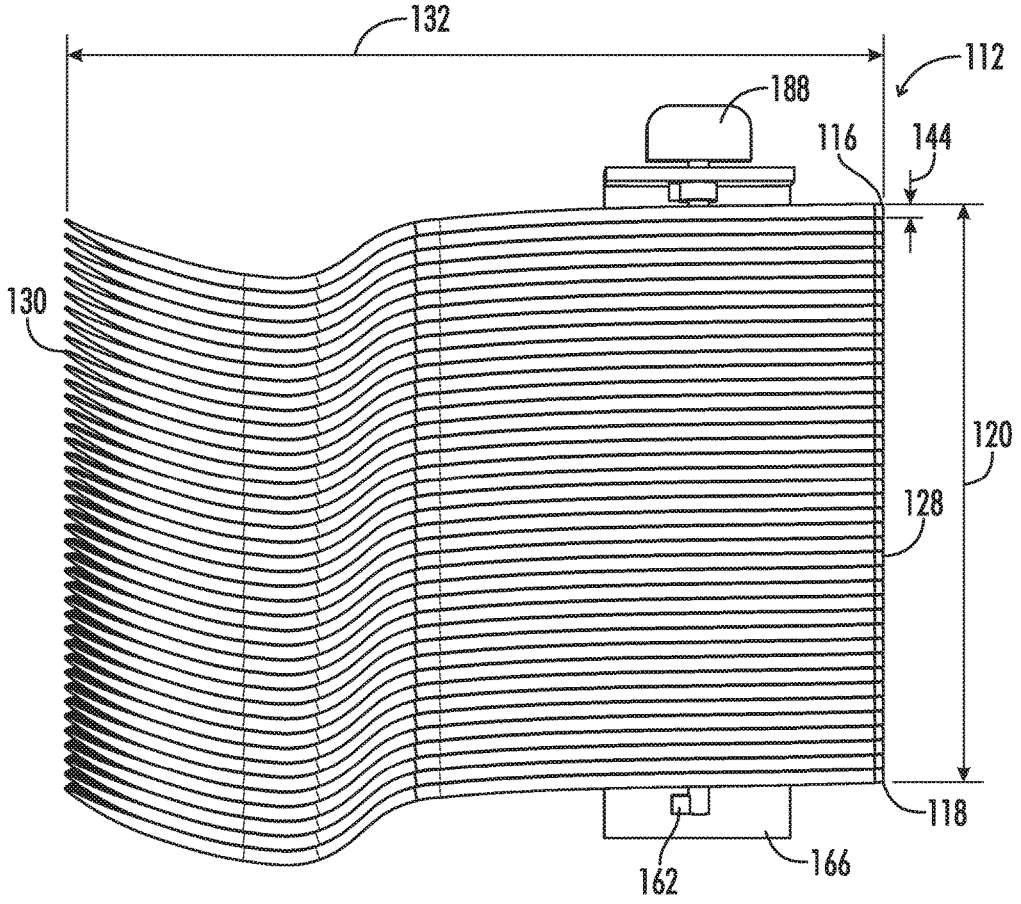
FIG. 5 illustrates a rear elevation view of the skewer system of FIG. 2.
Figure 6:
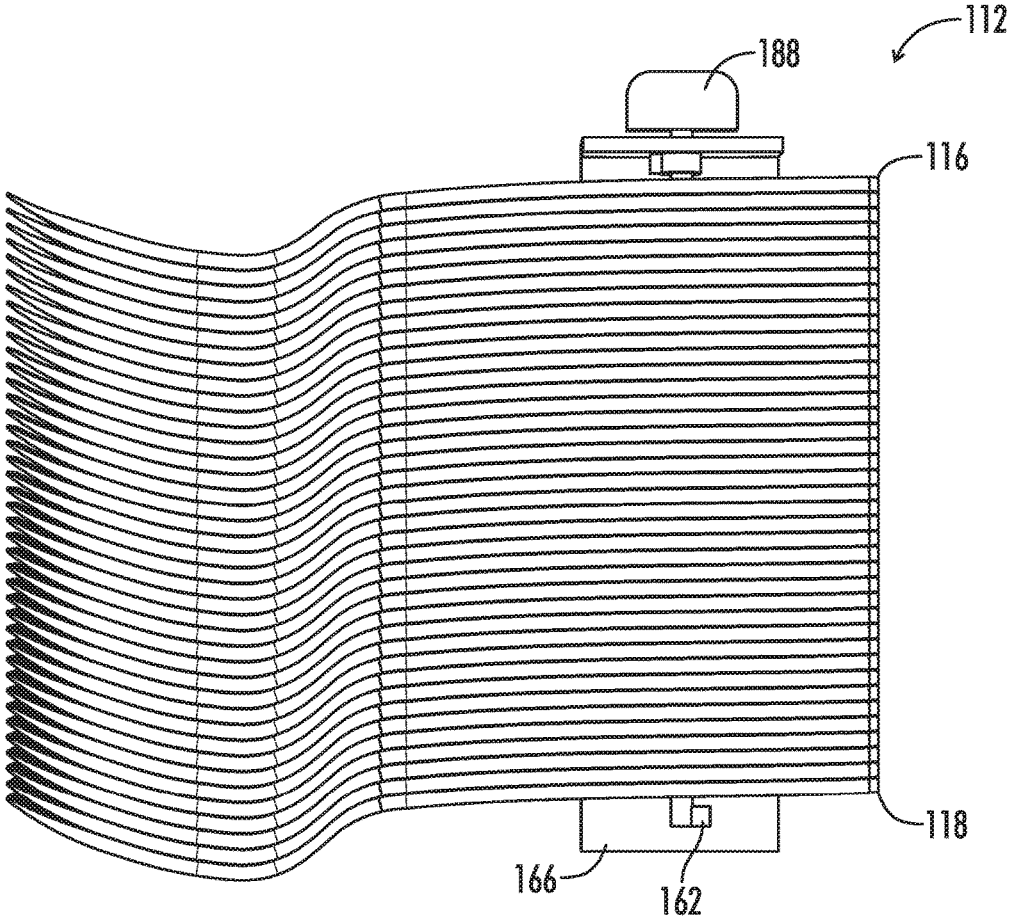
FIG. 6 illustrates a rear elevation view of the skewer system of FIG. 2.
Figure 7:
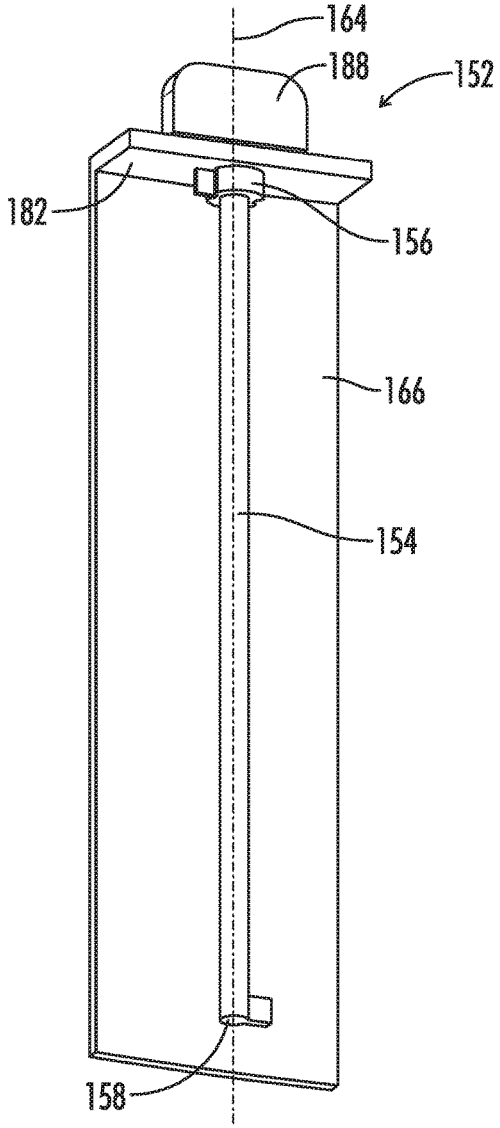
FIG. 7 illustrates a rear perspective view of the skewer of the skewer system of FIG. 2.
Figure 8:
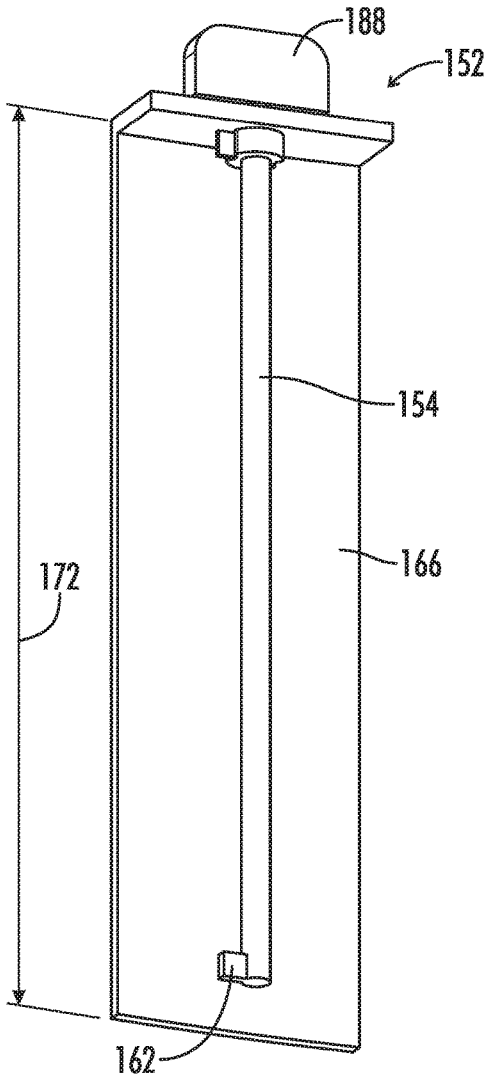
FIG. 8 illustrates a rear perspective view of the skewer of the skewer system of FIG. 2.

Referring to FIGS. 1-10, the present disclosure provides a skewer system generally designated by the numeral 110. In the drawings, not all reference numbers are included in each drawing for the sake of clarity.

Referring to FIGS. 1-10, the skewer system 110 includes a stack 112 of pieces of cutlery 114. The stack 112 has a top 116, a bottom 118, a height 120 extending from the top 116 to the bottom 118, a front side 122, a rear side 124, a width 126 extending from the front side 122 to the rear side 124 and generally perpendicular to the height 120, a left side 128, a right side 130, and a length 132 extending from the left side 128 to the right side 130 and generally perpendicular to the width 126 and the height 120. Each piece of cutlery 114 has a top 140, a bottom 142, a height extending from the top 140 to the bottom 142 and generally parallel to the stack height 120, a front side 144, a rear side 146, a width 148 extending from the front side 144 to the rear side 146 and generally parallel to the stack width 126, an eating portion 134 and a handle 136 extending from the eating portion 134 and comprising a handle tip 137 and a hole 138 extending from the cutlery piece top 140 to the cutlery piece bottom 142. (The eating portion 134 is also referred to in the art as the food contact portion of the cutlery such as the serrations of a knife, the tines of a fork, and the bowl of a spoon). The hole 138 may be non-circular, as best seen in FIG. 1.

The skewer system 110 further includes a skewer 152 removably attached to the stack 112 and comprising a vertical shaft 154 comprising a vertical shaft top 156 located above the stack top 116, a vertical shaft bottom 158 located below the stack bottom 118, a vertical shaft height 160 extending from the vertical shaft top 156 to the vertical shaft bottom 158 and generally parallel to the stack height 120, and a vertical shaft flange 162 located adjacent to (i.e., at or near) the vertical shaft bottom 158 and located below the stack bottom 118. The vertical shaft 154 is positioned through the holes 138 of the cutlery pieces 114. The holes 138 of each cutlery piece 114 are generally the same size and shape and are also aligned in the stack 112 to permit passage of vertical shaft 154. The vertical shaft 154 is configured to rotate about a rotation axis 164, which is generally parallel to the stack height 120 and the vertical shaft height 160, between a locked position in which the vertical shaft flange 162 is unable to pass through the hole 138 in the cutlery pieces 114 and an unlocked position in which the vertical shaft flange 162 is able to pass through the hole 138 in the cutlery pieces 114. For example, in a non-limiting example, the hole 138 may be key-shaped and the vertical shaft bottom 158 may also be key-shaped, as best seen in FIGS. 1, 3, and 4-10.

Figure 9:
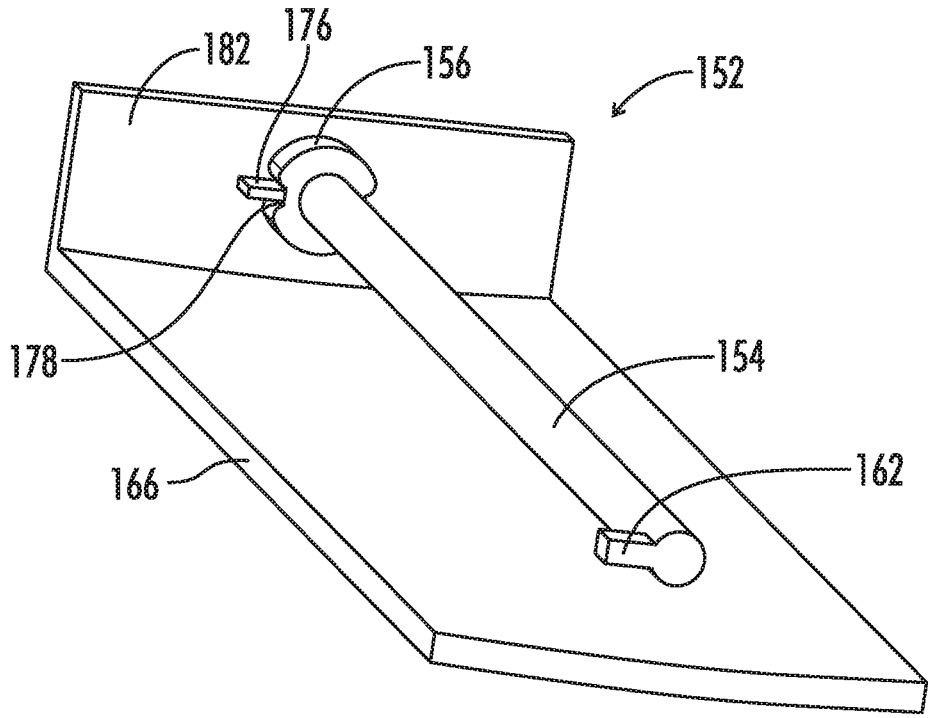
FIG. 9 illustrates a bottom perspective view of the skewer of the skewer system of FIG. 2.

The skewer system 110 may further comprise a lock configured to prevent the vertical shaft 154 from freely rotating between the locked position and the unlocked position. More particularly, the skewer 152 may further include a front tab bar 166 comprising a front tab bar top 168 located above the top 116 of the stack 112, a front tab bar bottom 170 located below the bottom 118 of the stack 112, and a front tab bar height 172 extending from the front tab bar top 168 to the front tab bar bottom 170, the front tab bar height 172 generally parallel to the vertical shaft height 160 and the stack height 120, the front tab bar 166 extending along the stack height 120 and confronting the front sides 146 of the cutlery pieces 114 as the front tab bar 166 extends along the stack height 120 and a top lateral extension 174 extending from the front tab bar 166 generally perpendicular to the front tab bar height 172 and located directly above the top 116 of the stack 112. In such a case, the aforementioned lock may comprise a top lateral extension tooth 176 located on the top lateral extension 174 and a first vertical shaft slot 178 located on the vertical shaft 154 and above the stack top 116 and configured to receive the top lateral extension tooth 176, and further wherein the top lateral extension tooth 176 is located in the first vertical shaft slot 178 when the vertical shaft 154 is in the locked position, as best seen in FIG. 9.

Figure 10:
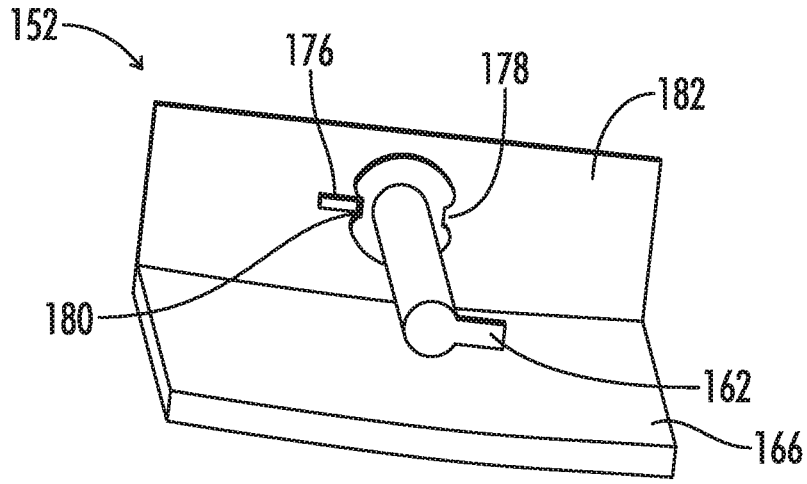
FIG. 10 illustrates a bottom perspective view of the skewer of the skewer system of FIG. 2.

Optionally, the top lateral extension tooth 176 is configured to flex and move out of the first vertical shaft slot 178 when a user rotates the vertical shaft 154 about the rotational axis 164. Optionally, the vertical shaft 154 further comprises a second vertical shaft slot 180 located on the vertical shaft 154 between about 20 and about 330 degrees relative to the first vertical shaft slot 178 and above the stack top 116, and further wherein the top lateral extension tooth 176 is located in the second vertical shaft slot 180 when the vertical shaft 154 is in the unlocked position, as best seen in FIG. 10. Optionally, the top lateral extension tooth 176 is configured to flex and move out of the second vertical shaft slot 180 when a user rotates the vertical shaft 154 about the rotational axis 164.

Optionally, the top lateral extension 174 comprises a bottom surface 182 facing the cutlery stack 112 and a top surface 184 opposite the bottom surface 182 and further wherein the top lateral extension tooth 176 is located on the bottom surface. Optionally, the skewer 152 further includes a handle 188 located above the top lateral extension 174 and configured to allow the user to rotate the vertical shaft 154 about the rotational axis 164. Optionally, the portion of the vertical shaft 154 extending along the stack height 120 (i.e., the portion of the vertical shaft 154 located in the holes 138) is generally cylindrical in shape (the generally cylindrical shape is shown in FIGS. 7-10 though the cutlery pieces 112 are not shown in FIGS. 7-10 for ease of illustration).

Optionally, the holes 138 and the vertical shaft flange 162 are substantially the same shape and size, it being understood that the surface area of the holes 138 may be slightly larger than the surface area of the bottom of the vertical shaft flange 162—e.g., 0.001% to 5% larger—to allow the vertical shaft flange 162 to be lifted through the holes 138 in the cutlery pieces 114.

To load the skewer system 110 in a cutlery dispenser, the system 110 is provided with the vertical shaft 154 in the locked position and the top lateral extension tooth 176 in the first vertical shaft slot 178. The skewer system 110 is loaded into the cutlery dispenser. The user rotates the vertical shaft 162 between approximately 20 degrees and approximately 330 degrees about the rotational axis 164 so that the top lateral extension tooth 176 enters the second vertical shaft slot 180. The user then lifts the vertical shaft 154 through the holes 138. Finally, the user removes the skewer 154 without removing the cutlery stack 112 from the cutlery dispenser. (As used herein the term "cutlery dispenser" refers to any device or component thereof that can be used to dispense cutlery, including cutlery dispensers such as the DIXIE SMARTSTOCK cutlery dispenser (Georgia-Pacific, Atlanta, Ga.) and the KLEENPAK cutlery dispenser cartridge (California; www.kleenpak.com).

Optionally, the skewer system 10 is a single use, disposable system made out of plastic.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

PART LIST

| | |
|---|---|
| skewer system | 110 |
| stack | 112 |
| pieces | 114 |
| stack top | 116 |
| stack bottom | 118 |
| stack height | 120 |
| stack front | 122 |
| stack rear | 124 |
| stack width | 126 |
| stack left side | 128 |
| stack right side | 130 |
| stack length | 132 |
| cutlery eating portion | 134 |
| cutlery handle | 136 |
| cutlery handle end | 137 |
| cutlery hole | 138 |
| cutlery piece top | 140 |
| cutlery piece bottom | 142 |
| cutlery piece height | 144 |
| cutlery piece front | 146 |
| cutlery piece rear | 148 |
| cutlery piece width | 150 |
| skewer | 152 |
| vertical shaft | 154 |
| shaft top | 156 |
| shaft bottom | 158 |
| shaft height | 160 |
| vertical shaft flange | 162 |
| rotation axis | 164 |
| front tab bar | 166 |
| front tab bar top | 168 |
| front tab bar bottom | 170 |
| front tab bar height | 172 |
| top lateral extension | 174 |
| top lateral extension tooth | 176 |
| first vertical shaft slot | 178 |
| second vertical shaft slot | 180 |
| top lateral extension bottom | 182 |
| top lateral extension top | 184 |
| handle | 188 |

What is claimed is:

1. A skewer system for loading a stack of cutlery pieces into a cutlery dispenser comprising:

a) a stack of pieces of cutlery, the stack comprising a top, a bottom, a height extending from the top to the bottom, a front side, a rear side, a width extending from the front side to the rear side, a left side, a right side, and a length extending from the left side to the right side, and further wherein each piece of cutlery comprises a top, a bottom, a height from the top to the bottom and generally parallel to the stack height, a front side, a rear side, a width extending from the front side to the rear side and generally parallel to the stack width, an eating portion, a handle extending from the eating portion, the handle comprising a handle end and a non-circular hole extending from the cutlery piece top to the cutlery piece bottom; and b) a skewer removably attached to the stack and comprising a vertical shaft comprising a vertical shaft top located above the stack top, a vertical shaft bottom located below the stack bottom, a vertical shaft height extending from the vertical shaft top to the vertical shaft bottom and generally parallel to the stack height, and a vertical shaft flange located adjacent to the vertical shaft bottom and located below the stack bottom, the vertical shaft positioned through the non-circular holes of the cutlery pieces, the vertical shaft rotatable relative to the stack of cutlery pieces along a rotation axis generally parallel to the stack height, wherein the vertical shaft is configured to rotate about the rotation axis between a locked position in which the vertical shaft flange is unable to pass through the non-circular hole in the cutlery pieces and an unlocked position in which the vertical shaft flange is able to pass through the non-circular hole in the cutlery pieces.

2. The skewer system of claim 1 wherein at least a portion of the vertical shaft extending along the stack height is generally cylindrical in shape.

3. The skewer system of claim 1 wherein the non-circular hole and the vertical shaft flange are substantially the same shape and size.

4. The skewer system of claim 1 wherein the system further comprises a lock configured to prevent the vertical shaft from freely rotating between the locked position and the unlocked position.

5. The skewer system of claim 4 wherein the skewer further comprises a front tab bar comprising a front tab bar top located above the top of the stack, a front tab bar bottom located below the bottom of the stack, and a front tab bar height extending from the front tab bar top to the front tab bar bottom, the front tab bar height generally parallel to the vertical shaft height and the stack height, the front tab bar extending along the stack height and confronting the front sides of the cutlery pieces as the front tab bar extends along the stack height and a top lateral extension extending from the front tab bar generally perpendicular to the front tab bar height and located directly above the top of the stack.

6. The skewer system of claim 5 wherein the lock comprises a top lateral extension tooth located on the top lateral extension and a first vertical shaft slot located on the vertical shaft and above the stack top and configured to receive the top lateral extension tooth, and further wherein the top lateral extension tooth is located in the first vertical shaft slot when the vertical shaft is in the locked position.

7. The skewer system of claim 5 wherein the top lateral extension comprises a bottom surface facing the cutlery stack and a top surface opposite the bottom surface and further wherein the top lateral extension tooth is located on the bottom surface.

8. The skewer system of claim 5 wherein the skewer further comprises a handle located above the top lateral extension and configured to allow the user to rotate the vertical shaft about the rotational axis.

9. The skewer system of claim 6 wherein the top lateral extension tooth is configured to flex and move out of the first vertical shaft slot when a user rotates the vertical shaft about the rotational axis.

10. The skewer system of claim 6 wherein the vertical shaft further comprises a second vertical shaft slot located on the vertical shaft between about 20 degrees and about 330 degrees relative to the first vertical shaft slot and above the stack top, and further wherein the top lateral extension tooth is located in the second vertical shaft slot when the vertical shaft is in the unlocked position.

11. The skewer system of claim 10 wherein the top lateral extension tooth is configured to flex and move out of the second vertical shaft slot when a user rotates the vertical shaft about the rotational axis.

12. A method of loading a cutlery dispenser comprising the steps of:

a) providing a cutlery dispenser;

b) loading the skewer system of claim 1 into the cutlery dispenser wherein the vertical shaft is in the locked position;

c) rotating the vertical shaft between about 20 and about 330 degrees about the rotational axis;

d) lifting the vertical shaft through the non-circular holes; and e) removing the skewer from the cutlery dispenser without removing the cutlery stack from the cutlery dispenser.

* * * * *